United States Patent [19]

Aaron

[11] Patent Number: 4,602,735

[45] Date of Patent: Jul. 29, 1986

[54] DISPENSING CARTON

[75] Inventor: Kenneth A. Aaron, Pierrefonds, Canada

[73] Assignees: Condor Litho & Carton Inc., Lasalle; Ad-Pak Enterprises, Pierrefonds, both of Canada; a part interest

[21] Appl. No.: 675,377

[22] Filed: Nov. 27, 1984

[30] Foreign Application Priority Data

Nov. 1, 1984 [CA] Canada ..... 466801

[51] Int. Cl.[4] ..... B65D 5/72

[52] U.S. Cl. ..... 229/17 B; 221/305; 229/7 R

[58] Field of Search ..... 229/17 B, 7 R; 221/90, 221/133, 303, 305, 306, 34; 222/572; 206/621

[56] References Cited

U.S. PATENT DOCUMENTS

| | | | |
|---|---|---|---|
| 1,392,429 | 10/1921 | Maheux | 229/17 B |
| 2,233,488 | 3/1941 | Powell | 229/7 |
| 2,684,792 | 7/1954 | Kraus | 222/457 |
| 2,803,390 | 8/1957 | MacKay | 229/17 B |
| 2,847,153 | 8/1958 | Guyer et al. | 229/17 B |
| 2,909,310 | 10/1959 | Govang | 229/17 B |
| 3,161,341 | 12/1964 | Farquhar | 229/17 |
| 3,207,380 | 9/1965 | Hennessey | 222/183 |
| 3,593,908 | 7/1971 | Desmond et al. | 229/17 |
| 3,944,128 | 3/1976 | Hogan | 229/17 |
| 4,201,292 | 5/1980 | Davidson et al. | 206/621 |

FOREIGN PATENT DOCUMENTS 1161645 3/1958 France .

*Primary Examiner*—William Price
*Assistant Examiner*—Gary E. Elkins
*Attorney, Agent, or Firm*—Beveridge, DeGrandi & Weilacher

[57] ABSTRACT

A dispensing bin type of carton of the type having a pull-out lower front panel controlled by sliding lock tabs is formed from a single blank which can be glued by a straight-line gluer machine and then folded to form a flattened sleeve. The design is such that the sleeve can be set up and filled with articles through one of its sides, and then closed by conventional automatic machinery. The blank for the carton has panels at one of its ends forming the lower front panel and sliding lock tabs and near to the other end of the blank is an aperture surrounded by the upper front panel, side panels, and a bottom connecting panel which is arranged to be glued to a bottom panel adjacent the lower front panel. In folding the blank to form the sleeve an upper edge of the lower front panel is inserted into the aperture to overlap the front of the upper front panel.

6 Claims, 3 Drawing Figures

DISPENSING CARTON

FIELD OF THE INVENTION

This invention relates to a dispensing bin type of carton formed of paperboard, of the type having a pull-out lower front panel which can be tilted outwards to allow articles to be removed from near the bottom of the carton, the movement of this panel being limited by sliding lock tabs extending perpendicularly to the lower front panel. This invention provides a blank for a carton of this kind (hereinafter referred as "of the type described") which can be made up, filled and used more easily than such cartons which were previously known.

PRIOR ART

One known form of dispensing bin carton presently used is formed from a blank which is folded along parallel fold lines and then glued along a joint to make a sleeve which can be shipped flat. When the carton is to be set up and filled, the parts forming the pull-out lower front panel and its sliding locking tabs have to be folded by hand since they require a more complex folding procedure than is available on standard machines. This manual work greatly adds to the cost of using such a carton. Examples of such cartons are shown in U.S. Pat. No. 2,333,488 which issued Mar. 4, 1941 to Powell, and U.S. Pat. No. 2,684,792 which issued July 27, 1954 to Kraus.

Another form of dispensing bin carton is made from a blank which provides a more or less conventional rectangular carton, but in which the front panel of the carton is provided with lines of weakening which allow the pull-out lower front panel to be separated along its sides and upper edge from the adjacent parts of the carton when this is to be opened by the final user. Examples of such cartons are shown in U.S. Pat. No. 3,593,908 which issued July 20, 1971 to Desmond et al., and U.S. Pat. No. 3,944,128 which issued on Mar. 16, 1976 to Hogan. The necessity to tear the lower front panel from the remainder of the carton is a nuisance to the final user, and of course such tearing often does not occur along the proper lines of weakening.

A third form of known carton is one in which the lower front panel and the sliding lock tabs, and some associated parts, are formed from a blank which is separate from the blank forming the main part of the container. Such designs are shown in U.S. Pat. No. 3,161,341 which issued Dec. 15, 1964 to Farquhar and U.S. Pat. No. 3,207,380 which issued Sept. 21, 1965 to Hennessey.

SUMMARY OF THE INVENTION

The present invention provides a blank for forming a dispensing bin carton, which blank can be formed into a sleeve in a simple manner, preferably by a simple straight line gluer machine. The sleeve is such that it can be shipped flat to the manufacturer wishing to use the carton for his product, and can be set up, filled and closed by this manufacturer using conventional carton filling and closing machines and without any hand labor. The filled carton can be opened by the end user without tearing of any parts being necessary.

In accordance with the present invention, a blank for forming a dispensing bin carton of the type described has:

an end portion including a lower front panel and sliding lock tabs for limiting movement of the lower front panel in use and which are hingedly attached to opposite ends of the lower front panel, the lower front panel having a free edge forming part of an end of the blank;

a bottom panel connected by a first fold line to the lower front panel;

a back panel connected by a second fold line to the bottom panel;

a top panel connected by a third fold line to the back panel;

a upper front panel connected by a fourth fold line to the top panel, this upper front panel having side panels hingedly connected to its ends; and a bottom connecting panel connected by intermediate panel means and by a fifth fold line to the side panels, the connecting panel being spaced from the upper front panel to provide an aperture surrounded by the bottom connecting panel, the upper front panel, and said side panels.

The lower front panel and the upper front panel are arranged so that the blank may be formed into a sleeve by folding about the fold lines, which fold lines are all parallel to each other, and by gluing said bottom connecting panel to the outside of the bottom panel after a free end part of the lower front panel has been inserted into the aperture so as to overlap with that edge of the upper front panel adjacent the aperture.

The arrangement whereby a bottom connecting panel, separated from an upper front panel portion by an aperture, can be glued to the bottom panel allows conventional dust flaps for the sides of the carton to be provided exclusively on the top panel and bottom connecting panel. No such dust flaps are needed on the bottom panel which means that glue can be applied to this latter panel by a straight line gluer machine.

The dust flaps connected to the top panel and bottom connecting panel are preferably separate conventional dust flaps which are not directly connected to the side panels. With this type of flap, the dust flaps and side panels can be folded by conventional machinery without any hand labor. The sliding lock tabs are positioned so that they are automatically folded into position when the dust flaps and side panels are folded. With this dust flap arrangement, the intermediate panel means connecting the bottom connecting panel to the side panels comprise small triangular panels at opposite corners of the aperture and which are hingedly connected both to the side panels and to the bottom connecting panel.

BRIEF DESCRIPTION OF THE DRAWINGS

The invention will further be described by way of example with reference to the accompanying drawings which show a preferred embodiment, and in which.

DETAILED DESCRIPTION

Figure 1:
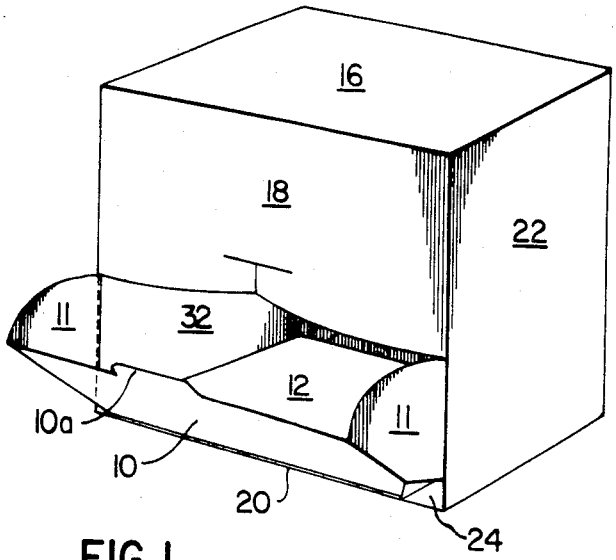
FIG. 1 shows a perspective view of the completed carton in dispensing mode.

The carton shown in FIG. 1 is similar to known dispensing cartons in having a pull-out lower front panel 10 with an upper tab 10*a*, the movement of which is limited by sliding lock tabs 11. The carton also has a bottom panel 12, a rear panel 14, a top panel 16, an upper front panel 18, and side panels 22.

Figure 2:
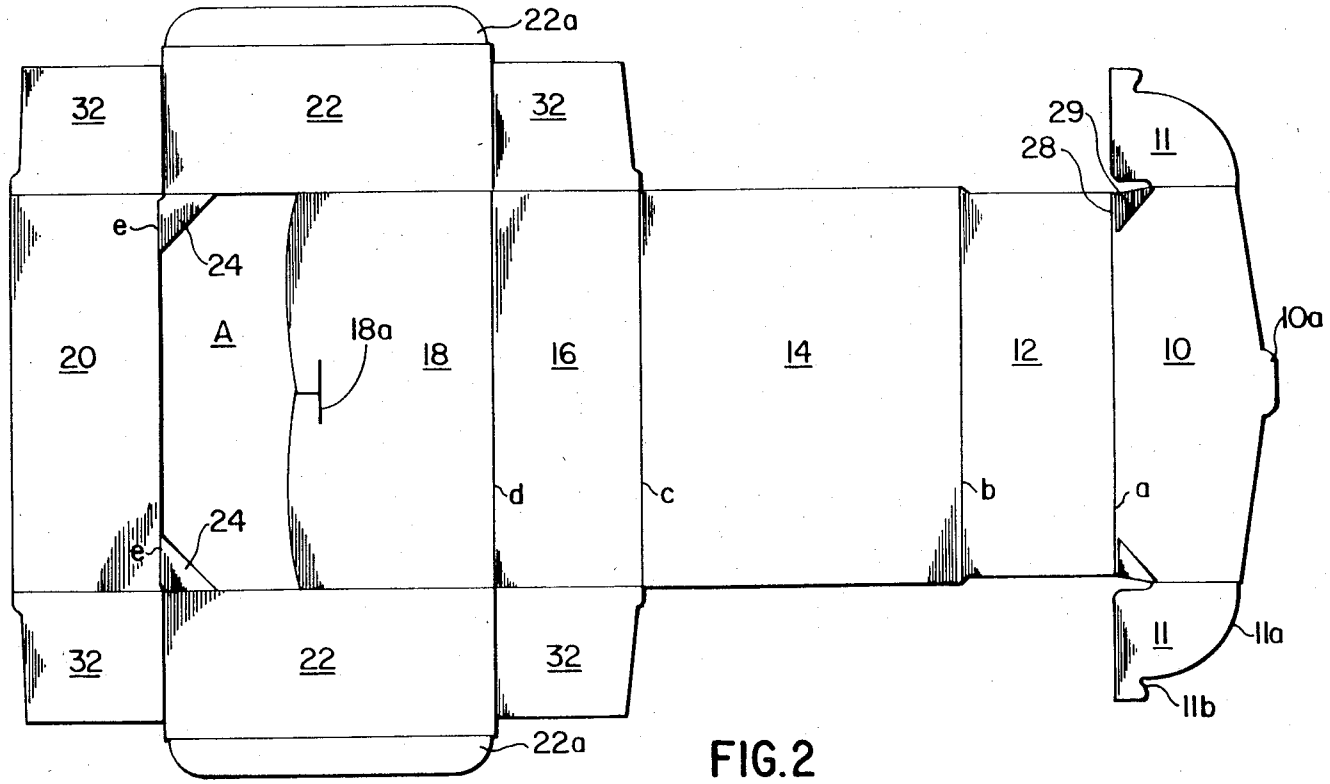
FIG. 2 shows a plan view of the blank to form the carton of FIG. 1.

FIG. 2 shows the unique blank which is used to make this carton. As shown in FIG. 2, panel 10 and tabs 11 form an end portion of the blank, the panel 10 having a free edge forming a portion of the end of the blank and which eventually becomes the upper edge of the lower front panel. The lock tabs 11, which are hingedly connected to panel 10, have an arcuate edge 11*a* terminating in a reverse angle shoulder 11*b*.

The bottom panel 12 is connected by first fold line a to the panel 10, and the back panel 14 is connected by second fold line b to the bottom panel 12. The top panel 16 is connected by third fold line c to the back panel, and the front upper panel 18 is connected by a fourth fold line d to the top panel. The panel 18 has the side panels 22 hingedly connected to its ends, and each side panel 22 has a tuck in flap 22*a*. Panel 18 also has a T shaped slit formation 18*a* at its centre and adjacent the aperture.

The bottom connecting panel 20 is connected by intermediate panel means 24 to parts of the side panels 22 which extend beyond the outer edge of upper front panel 18. The panels 24 are connected to side panels 22 by fold lines which are aligned with those connecting panels 22 to panel 18, and also by fifth fold lines e to the panel 20. As is evident, fold lines a, b, c, d, and e are all parallel. As seen in FIG. 1, it would be expected that the small panels 24 would interfere to some extent with the opening of the lower front panel 10, but in order to minimize such interference the fold line a has small slits 28 adjacent its ends, and the panel 10 has fold lines 29 across its corners connecting with the slits 28, and these allow the lower corners of the lower panel 10 to fold inwardly when contacted by the panels 24.

The top panel 16 and bottom connecting panel 20 each have at their ends dust flaps 32. These are simple flaps which are unconnected with the adjacent edges of the side panels 22, and are of such nature that they can be folded by conventional machinery.

Figure 3:
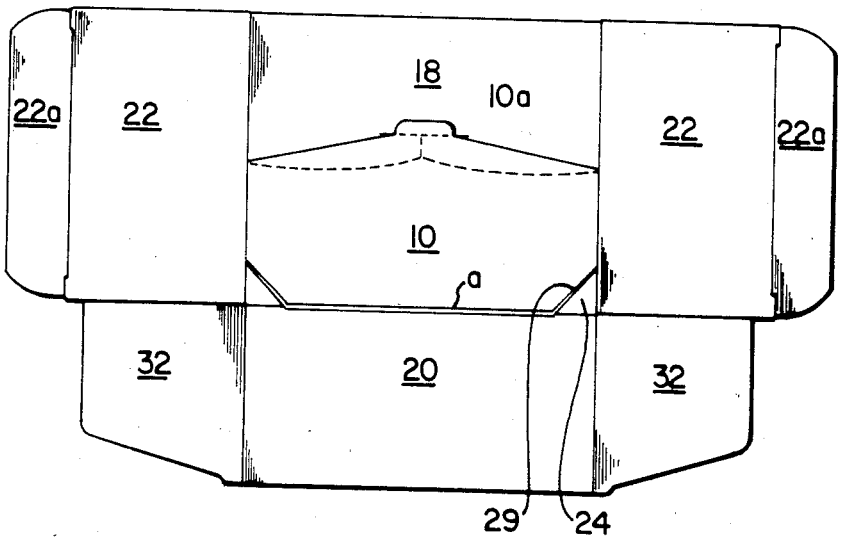
FIG. 3 shows the sleeve which is formed by initial folding and gluing of the blank.

Folding of the carton will now be described with reference both to FIGS. 2 and 3.

The blank shown in FIG. 2 is fed into a gluer machine and then folded over from right to left along the fold line b. Two lines of glue are then applied overhead to the outside of the bottom panel 12, after which the folded portion is allowed to spring back upwards so that it lies at an acute angle of about 45 degrees to the back panel 14. As the blank passes further along in the machine, it is folded from left to right along score line d, bringing the bottom connecting panel 20 over on top of the bottom panel 12. As this folding occurs, tab 10*a* and associated centre portion of the panel 10 passes into the aperture A until these parts lie above and overlap with the edge of the panel 18 adjacent the aperture A. The blank is then pressed down flat to glue the connector panel 20 firmly to the bottom panel 12. It will be noted that since panel 12, which receives the glue, does not have any dust flaps, the gluing can be done by a straight-line gluer machine. The sleeve so produced is shown in FIG. 3.

The sleeve so produced can be shipped flat to a manufacturer for filling. The sleeve can be set up, have one side closed, filled, and have the other side closed, all by conventional automatic machinery capable of folding the conventional dust flaps shown. The sliding lock tabs 11 will be folded automatically when the side panels 22 are folded and will then slide in the gaps between side panels 22 and the adjacent dust flap and will not be impeded by material in the carton.

As a final step, the tab 10*a* may be pushed into the slit formation 18*a;* the combination of tab 10*a* and slit formation 18*a* provide interlocking means to hold the lower front panel closed.

The end user of the carton can easily release tab 10*a* by pressing in the sides of the box and pulling out the panel 10 until the shoulders 11*b* of sliding lock tabs 11 engage the fold lines between front upper panel 18 and side panels 22.

The need for panels 24 may be avoided by using folding dust flaps which provide permanent connection between side panels 22 and bottom connecting panel 20; such dust flaps would serve as the "intermediate panel means" referred to above. This would also avoid the need for slits 28 and fold lines 29. However folding dust flaps are not preferred since they are not readily folded by conventional automatic machinery.

As an alternative to providing dust flaps 32 on bottom connecting panel 20, these might be provided on bottom panel 12; in this case the glue could be applied by the gluing machine to the panel 20 rather than panel 12.

A seal end flap arrangement could also be provided by adding side flaps to the back panel 14.

I claim:

1. A blank for forming a dispenser bin carton of the type having a pull-out lower front panel hinged to move from a closed to an open position allowing access to the lower part of the carton, said blank having:

an end portion including a lower front panel, and sliding lock tabs for limiting movement of the lower front panel in use and which are hingedly attached to opposite ends thereof; the lower front panel having a free end forming part of an end of the blank;

a bottom panel connected by a first fold line to the lower front panel;

a back panel connected by a second fold line to the bottom panel;

a top panel connected by a third fold line to the back panel;

an upper front panel connected by a fourth fold line to the top panel, this upper front panel having side panels hingedly connected to its ends, and a bottom connecting panel connected by intermediate panel means and by a fifth fold line to the side panels, the bottom connecting panel being spaced from the upper front panel to provide an aperture surrounded by the bottom connecting panel, the upper front panel, and said side panels, wherein said lower front panel is larger than said aperture and wherein said lower front panel and part of the upper front panel adjacent the aperture have interlocking means for holding the front panel closed when the carton is erected, and wherein said fold lines are all parallel to each other and said panels are arranged so that the blank may be formed into a sleeve by sequenced folding about said second and fourth fold lines and by gluing said bottom connecting panel to the outside of said bottom panel after said free end of said lower front panel has been inserted into said aperture so as to overlap outside that edge of the upper front panel adjacent the aperture.

2. A blank according to claim 1 wherein said bottom connecting panel is substantially the same size as said bottom panel and said bottom connecting panel and said top panel are both provided at their ends with dust flaps, said bottom panel being free of any end flaps and capable of receiving glue from a straight-line gluer machine.

3. A blank according to claim 2 wherein the said dust flaps have no direct connection with the side panels, and wherein said intermediate panel means connecting the bottom connecting panel to the side panels include panels at the corners of said aperture which are hingedly connected both to said side panels and to said bottom connecting panel.

4. A sleeve capable of being erected, without gluing, into a dispenser bin carton of the type having a pull-out lower front panel hinged to move from a closed to an open position allowing access to the lower part of the carton, said sleeve having:

a first portion including said lower front panel and sliding lock tabs for limiting movement of the lower front panel and which are hingedly attached to opposite ends of said lower front panel;

an inner bottom panel connected by a first fold line to the lower front panel;

a back panel connected by a second fold line to the bottom panel;

a top panel connected by a third fold line to the back panel;

an upper front panel connected by a fourth fold line to the top panel, this upper front panel having side panels hingedly connected to its ends; and an outer bottom connecting panel glued to the outer surface of said bottom panel and connected by intermediate panel means and by a fifth fold line to the side panels, the bottom connecting panel being spaced from the upper front panel to provide an aperture surrounded by the bottom connecting panel, the upper front panel, and said side panels; and wherein said lower panel is larger than said aperture and a free end part of said lower front panel projects through the aperture and overlaps outside an edge of said upper front panel adjacent the aperture and provides a tab which can be used to open the lower front panel when the side panels have been closed and said sliding lock tabs have been brought into the plane of said side panels said tab also providing a means interlocking with said upper front panel to hold the lower front panel closed.

5. A sleeve according to claim 4 wherein said bottom connecting panel and said top panel are both provided at their ends with dust flaps, wherein said dust flaps have no direct connection with the side panels, and wherein said intermediate panel means connecting the bottom connecting panel to the side panels include panels at the corners of said aperture which are hingedly connected both to said side panels and to said bottom connecting panel.

6. A carton formed from the sleeve of claim 4 or claim 5 by setting up the sleeve, closing one side panel, placing objects in the carton, and closing the remaining side panel.

* * * * *